United States Patent [19]

Ackermann et al.

[11] Patent Number: 4,482,047

[45] Date of Patent: Nov. 13, 1984

[54] CONTAINER

[75] Inventors: Horst W. Ackermann, Orbe, Switzerland; Jean-Pierre Guays, Reading, Great Britain

[73] Assignee: Societe d'Assistance Technique pour Produits Nestle S.A., Lausanne, Switzerland

[21] Appl. No.: 499,461

[22] Filed: May 31, 1983

[30] Foreign Application Priority Data

Jun. 4, 1982 [CH] Switzerland ..... 3459/82

[51] Int. Cl.[3] ..... B65D 81/32; B65D 85/72; B65D 85/78; A21D 10/02

[52] U.S. Cl. ..... 206/219; 206/216; 206/525; 220/93; 220/216; 426/115; 426/119; 426/120; 222/129; 222/583

[58] Field of Search ..... 206/219, 216, 525, 527; 220/93, 216; 222/129, 583; 426/115, 119, 120

[56] References Cited

U.S. PATENT DOCUMENTS

| | | | |
|---|---|---|---|
| 543,728 | 10/1895 | Spielman | 222/583 |
| 1,090,555 | 3/1914 | McWhorter | 220/216 |
| 1,514,379 | 11/1924 | Fleischer | 426/120 |
| 2,393,217 | 1/1946 | Brewton | 220/93 |
| 2,572,960 | 10/1951 | Steans | 220/93 |
| 2,789,731 | 4/1957 | Marraffino | 222/129 |
| 3,191,799 | 6/1965 | Figge | 220/93 |

*Primary Examiner*—William T. Dixson, Jr.
*Attorney, Agent, or Firm*—Vogt & O'Donnell

[57] ABSTRACT

A container comprising an outer container and an inner container suspended therein by flexible suspension means.

6 Claims, 2 Drawing Figures

Fig. 1
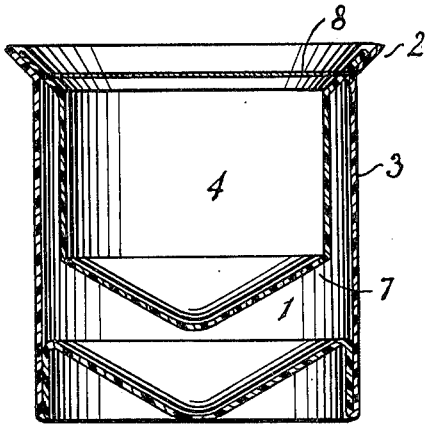
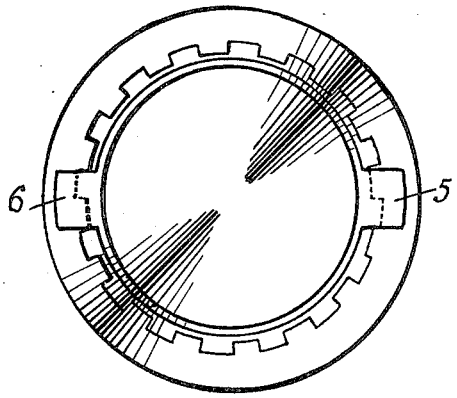
Fig. 2

CONTAINER

This invention relates to a container, more particularly a container for separately receiving two different products.

In the distribution of for example, food products, it is sometimes desirable to pack two products separately in the same package, to prevent any reaction between the two products before consumption. This applies in some cases to fruit and dairy produce. Subsequently, the two products may be mixed, but this does not always happen without the products overflowing or spilling or other inconvenient results.

This invention provides a composite container which facilitates the mixing of two products which were originally separated in two distinct containers, these being an outer container and an inner container.

According to the present invention, the inner container is suspended in the outer container by flexible suspension means.

The accompanying drawing illustrates, by way of example, one embodiment of the present invention.

FIG. 1 is an axial section of a container, and

FIG. 2 is a top view of the same container.

In the drawings, reference numeral 1 designates an outer container having a conical lip 2. An inner container 4 smaller than the outer container 1, is positioned inside the outer container so that it is capable of sliding therein. The outer container side wall 3 is ribbed, providing channels between the outer and the inner container. In other embodiments, the inner container is ribbed and the outer smooth, or both are ribbed, or both are smooth, leaving a passage between the side walls of the inner and outer container. In the position shown in the drawing, the inner container 4 being less deep than the outer container 1, there is a space between the bottom of the inner and the bottom of the outer container. The inner container is provided with two flexible tabs 5 and 6 by means of which it is suspended in the outer container.

In one preferred embodiment, the bottom of the inner container is provided with a cavity 7 of generally conical shape, the bottom of the outer container being of similar shape. In another embodiment, both bottoms bulge essentially upwards with a small downward bulge in the center. The inner container and the outer container are closed in conventional manner by a cover 8 sealed to the edge of the outer container.

By way of example, the inner container 4 may be filled with a dairy product, such as yoghurt, and the space between the bottom 7 of the inner container and the bottom of the outer container is filled with whipped cream.

For mixing and consumption of the contents, the consumer first of all removes the cover 8, and then inserts a spoon into the inner container until the spoon meets the bottom 7. The hollow shape of the bottom 7 of the inner container guides the end of the spoon towards the centre. By continuing to push downwards with the spoon, the tabs 5 and 6 give way, collapse inwards and the inner container descends. By this means, the whipped cream in the bottom of the outer container rises through the channels in the walls 3 of the outer container, and then drops into the inner container onto the yoghurt. By the time that the inner container has reached the bottom of the outer container, the yoghurt is topped with whipped cream, and is ready for consumption.

We claim:

1. A container, comprising an outer container and an inner container, said inner container being less deep than said outer container and being suspended in said outer container by flexible suspension means, a passage being provided between the side walls of said inner and said outer container, the bottom of said inner container and the bottom of said outer container being of similar shape.

2. A container according to claim 1, in which the flexible suspension means is adapted to be readily collapsed.

3. A container according to claim 1, in which said suspension means is a flexible tab.

4. A container according to claim 1, in which said outer container is provided with internal channels.

5. A container according to claim 1, in which said inner container is provided with a cavity at the bottom.

6. A container according to claim 5, in which said cavity is conical in shape.

* * * * *